US008001657B2

(12) United States Patent
Giordano

(10) Patent No.: US 8,001,657 B2
(45) Date of Patent: Aug. 23, 2011

(54) ADJUSTABLE SECURITY SYSTEM FOR BRACELETS

(76) Inventor: Giuseppe Giordano, Le Mont-sur-Lausanne (CH)

( * ) Notice: Subject to any disclaimer, the term of this patent is extended or adjusted under 35 U.S.C. 154(b) by 113 days.

(21) Appl. No.: 10/597,861

(22) PCT Filed: Feb. 10, 2005

(86) PCT No.: PCT/CH2005/000075

§ 371 (c)(1), (2), (4) Date: Apr. 10, 2007

(87) PCT Pub. No.: WO2005/077220

PCT Pub. Date: Aug. 25, 2005

(65) Prior Publication Data

US 2007/0180857 A1 Aug. 9, 2007

(30) Foreign Application Priority Data

Feb. 13, 2004 (CH) ..... 0218/04

(51) Int. Cl.
*A44C 5/24* (2006.01)

(52) U.S. Cl. ..... 24/71 J; 63/5.1; 224/176; 368/282

(58) Field of Classification Search ..... None
See application file for complete search history.

(56) References Cited

U.S. PATENT DOCUMENTS 1,985,835 A * 12/1934 Prestinari ..... 24/71 J
2,555,196 A * 5/1951 Kostka ..... 24/71 J

* cited by examiner

*Primary Examiner* — Jack W. Lavinder

(57) ABSTRACT

The present invention discloses a safety device for a bracelet including a system for adjusting the circumferential length of the bracelet. This system comprises;

first and second curvilinear elongated elements, each having a slot and a plurality of notches;

a clasp comprising a third curvilinear elongated element having a set of grooves, wherein the grooves receive one of the first or second elongated elements for slidably gliding the elements relative to one another, and a fourth curvilinear elongated element;

a button slidably secured in each slot of said first and second curvilinear elongated elements to slidably secure said first and second curvilinear elongated elements together;

a set of stop reliefs are provided within said grooves for limiting the sliding motion of the first and second curvilinear elongated elements.

The third and fourth curvilinear elongated elements are engaged with one another after the safety device is adjusted to a desired position in order to lock the device in that desired position.

1 Claim, 5 Drawing Sheets

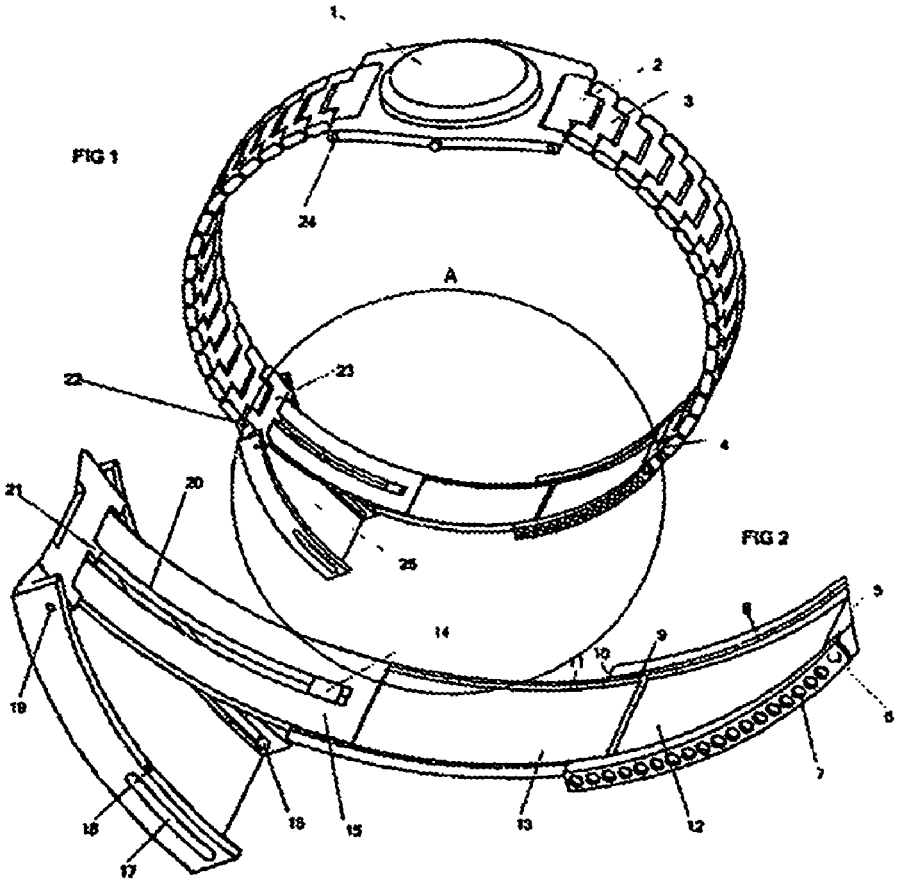
FIG 1
FIG 2
A
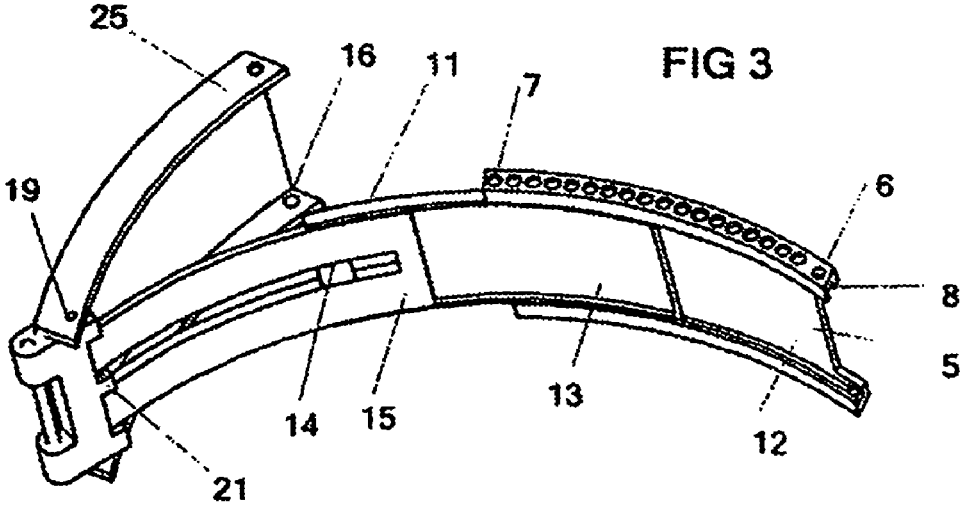
FIG 3
25
16
11
7
19
6
8
5
14
15
13
12
21

19
32
15
31
20

12
6
5
8
10

14
11
34
13
9

6
23
36
35

35
33
36
37
21
19

43
42
44
41

9
40

38
39

ADJUSTABLE SECURITY SYSTEM FOR BRACELETS

TECHNICAL DETAILS

The invention concerns a circular security system with a closed circuit, which prevents the wristwatch from falling during thr open and closing. The security system functions on the principle of telescoping part, guided so that the bracelet is lengthened or shortened. It features a graduated method for regulating the path, as well as an opening and closing system for wristwatch, ornaments, and other objects that would lend themselves to this usage. The elements that fit into each other for this telescoping system contain a stopping notch to stop the movement of each of them. Starting from the principle that the central part of the hand is larger than the wrist, we create a wrist watch based on this telescoping system, whose diameter can be reduced or enlarged, thus allowing the user to adjust it, close it, or open it very simply, using a graduated hinged cap which comes against the braces the telescoping system by an oppsite maneuver, until the external part of the telescoping system is hooked in the right place by a simple pressure of the user, once the correct fit to the wrist has been achieved.

PREVIOUS TECHNIQUES

Previous regulating system have been known, whose goal is the ajustment of the bracelet around the wtist. These are in the patents described below:

U.S. Pat. No. 1,997,723 J. J. Franklin, Jr, Extension devise for article of Jewelry, Nov. 4, 1933

It describes a lengthening device to put on and remove a ring; this function has no space for making a graduated adjustment possible; plate 18 and bar 14 become fixed in order to make book 21 effective; it is impossible, in this part, to imagine a graduated closure. The basis of the invention is made from separate pieces (see FIGS. 1 and 5), combination 8-10-4-6; the average of these parts defines the diameter of the ring before it is put on the finger. Someone in the business would immediately see the difference!

U.S. Pat. No. 203,202 Louis Fiessler & Co., D-Pforzheim, Ziehschloss fur Armbander, 16 Mai 1939

It describes a closure remotely positioned by an adjusting spring; even if the goal is to adjust a bracelet to a desired length, the methods for achieving it are different than the GIORDANO invention, which describes a security system featuring telescoping parts in a closed circuit, and in its linear path, a graduated adjustment with a hinged cap.

U.S. Pat. No. 2,542,358 Saul Ritter, New-York, Sep. 21 , 1945, Extensible Connector Fir Bracelet Or The Like It describes a enlargement by an unfolding loop and a sliding juncture to accomplish the adjustment. The sliding system, whose slots are filled with many illogical and incomprehensible complications, also generates significant productions costs for a questionable result. This in no way resembles the GIORDANO invention, which describes a telescoping system, whose closure is performed by the security system and the hinged cap. The two inventions offer functioning and production systems that are completely opposite.

U.S. Pat. No. 936,697 Gerald William Canston, London, Aug. 26, 1961, An Extensible Link Fastener for a Bracelet or Similar Article of Jewelry The closure features no security system, since the system can open when the closure is unhooked (FIG. f, part D). In addition, the functioning of the closure depends on a spring similar to the Fessler Patent.

Patent CH 669 501, Favre, Jacques, La Chauix-de-Fonds, Feb. 26, 1987, Closure with Automatically Adjusting Fold for Bracelets It describes an unfolding closure one of whose sides contains an opening that serves as a stabilizing guide to pull the bracelet over the unfolding loop. The function of the groove does not have the same goal as that of the groove in the GIORDANO invention. Once again, someone in the business would immediately recognize the difference. . .

U.S. Pat. No. 6,085,550 Mitsugi Ishida, New-York, Jul. 11, 2000, Adjustable Article of Jewelry and Related Method This patent refers almost exclusively to ring closures. There is no relationship to the characteristics of the GIORDANO invention.

After having examined the six patents listed above, I have come to the conclusion that none of these patents can claim a telescoping system that possesses an adjustment system that is graduated along its path, in combination with a secure closure, which also permits adjustment to the proper diameter, and opening and closing the wristwatch as easily and simply with a single available hand.

EXPLANATION OF THE INVENTION

For a long time now, users of wrist watches have shown a keen interest in a watch that would offer comfort, beauty, simplicity, and of course, easy adjustment to the wrist, without specific intervention by a jeweler, a mechanic, or anyone else. Even though the market has already proposed a few solutions, the situation today is not yet really satisfactory, especially due to technical limitations, the bulkiness, or the high production costs of the patented systems. Due to the importance of this need. I have invented a system that is secure and adaptable to wristwatches, ornaments, and other bracelets to which it could apply. The great novelty resides in the fact that the GIORDANO bracelet possesses a telescoping system featuring optimal hooking methods and a closure that is accomplished by a graduated coupling.

DETAILED DESCRIPTION

A safety device comprising elongate elements (1) guided by slots (2) and grooves (3). The recto-verso button (4) located between the slots of the elongate elements (1) allows the latter to be slid until the desired length is obtained.

The elongate elements (1) have notches (5). The latter are useful when closing and opening said elements, partly to maintain stability in the grooves (3) during the sliding action, and partly to prevent detachment of the elongate elements (1) of the bracelet.

The slots (2) stop before the end and enable the elongate elements (1) to be slid by means of the recto-verso button (4). The latter allows the elongate elements (1) to be stopped at the end of their motion.

The grooves (3) are provided with stop reliefs (7) or conical narrowings. These allow the elongate elements (1) to be stopped when they arrive at their maximum elongation.

The recto-verso button (4) allows the elongate elements (1) to hold them together and to exert a combined stopping action on the latter.

Once the bracelet is adapted to the size of the wrist, the elongate elements (1) are fixed by a clasp (6*a* and 6*b*). The latter is for locking the desired dimension at the desired position. When closed, all the elongate elements (1) lie snugly against each other.

The object of this invention is to allow each individual to adapt the length of the bracelet at any time to the size of his or her wrist by simple means.

After having performed a survey among wristwatch manufacturers, ornament makers, as well as among the professionals of the watch industry and users, the invention had an enormous success and the results seem very promising.

During the Salon International des Inventions in Geneva Apr. 6-10, 2005, I was the winner of the competition and received the 1$^{st}$ prize with Gold Medal, as well as the congratulations of the International Jury, for the invention of the Adjustable Security System for Bracelets, and others.

SUMMARY DESCRIPTION OF THE DRAWINGS

FIG. 1 represents the adjustable system of security for a bracelet, seen in one extension where all of the parts of the system are enlarged to the maximum diameter.

FIG. 2 represents a magnification of the telescoping system of FIG. 1.

FIG. 3 represents the telescoping system with a diminished length.

Figure 4A:
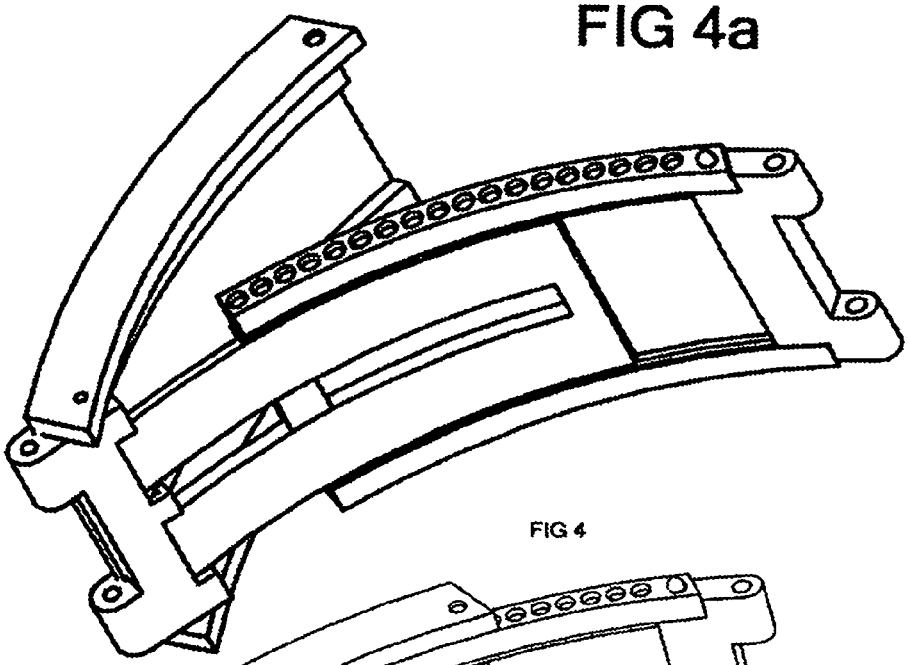
FIG. 4 represents a graduated coupling at one of the desired sizes.
Figure 4:
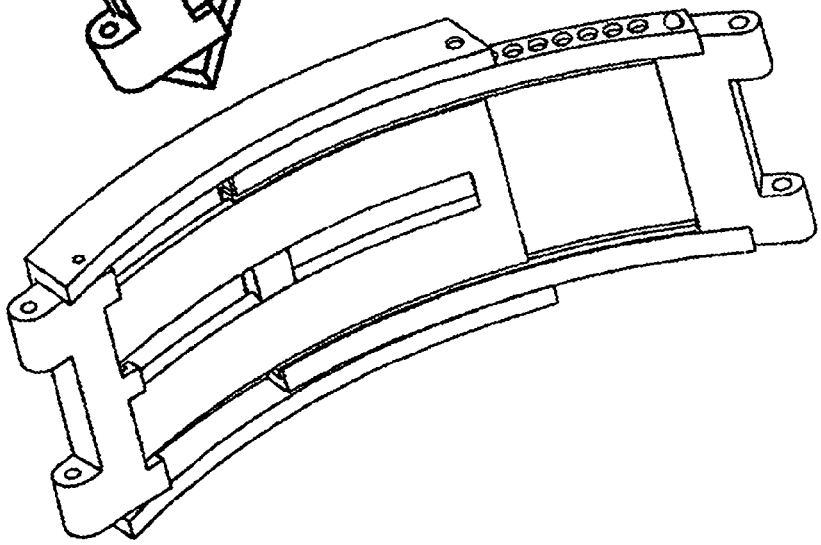

FIG. 4*a* represents the telescoping system in a partially opened system ready for the coupling.

Figure 5:
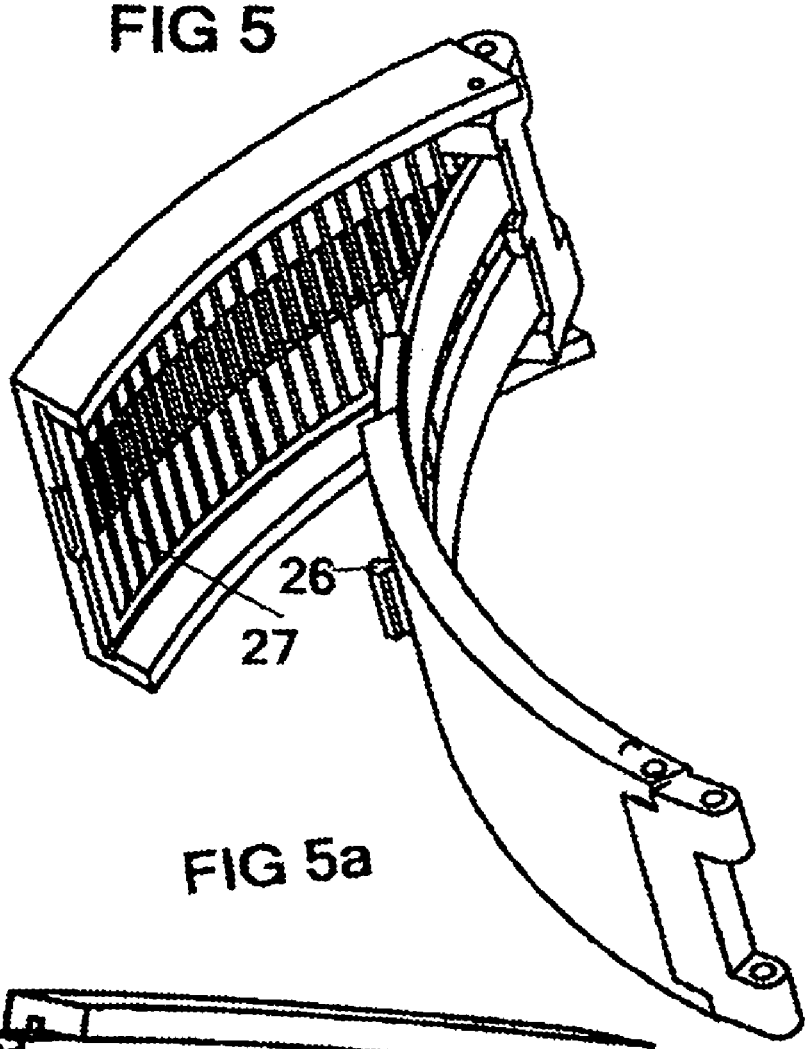

FIG. 5 represents a variation of the graduated coupling system.

Figure 5A:
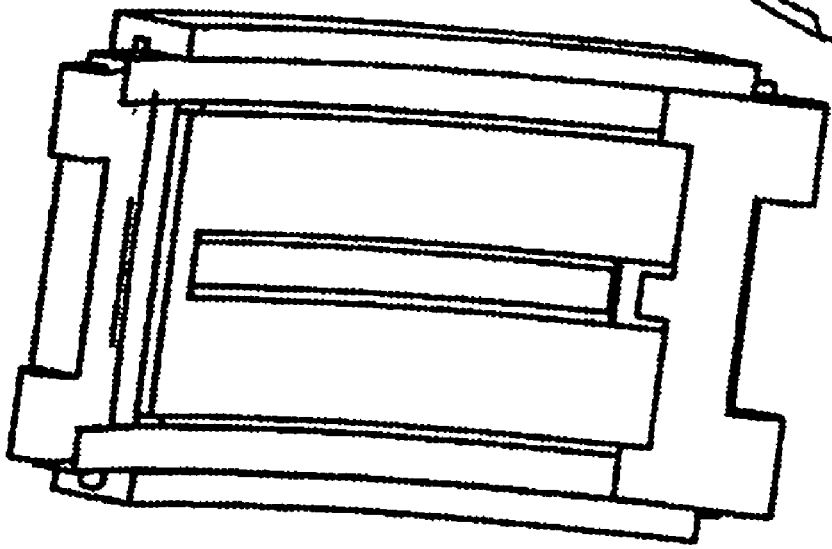

FIG. 5*a* represents the telescoping system closed to the maximum.

Figure 6A:
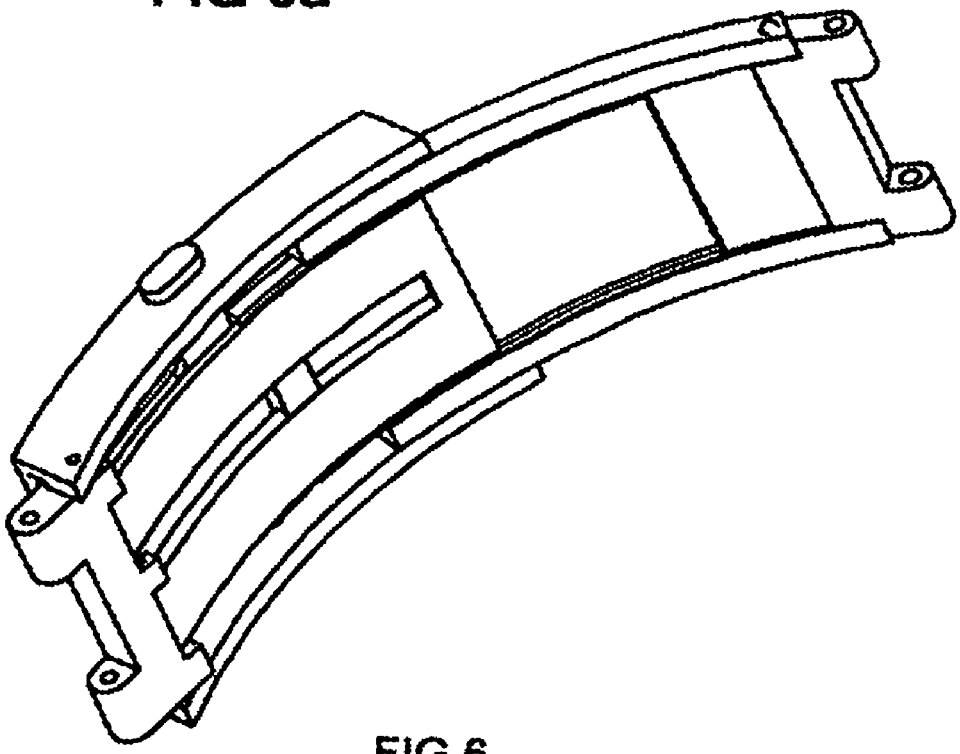
Figure 6:
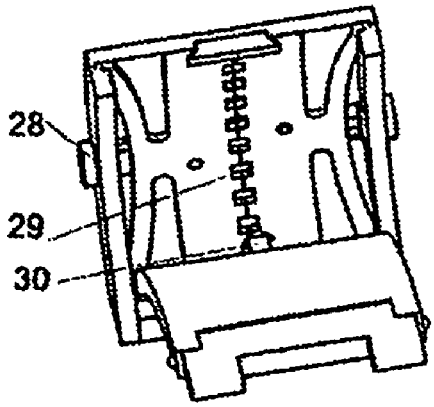

FIG. 6 is a different version of the coupling.

FIG. 6*a* represents FIG. 6 in the coupling phase.

Figures 7, 8, 9, 10, 11, 12, 13, 14:
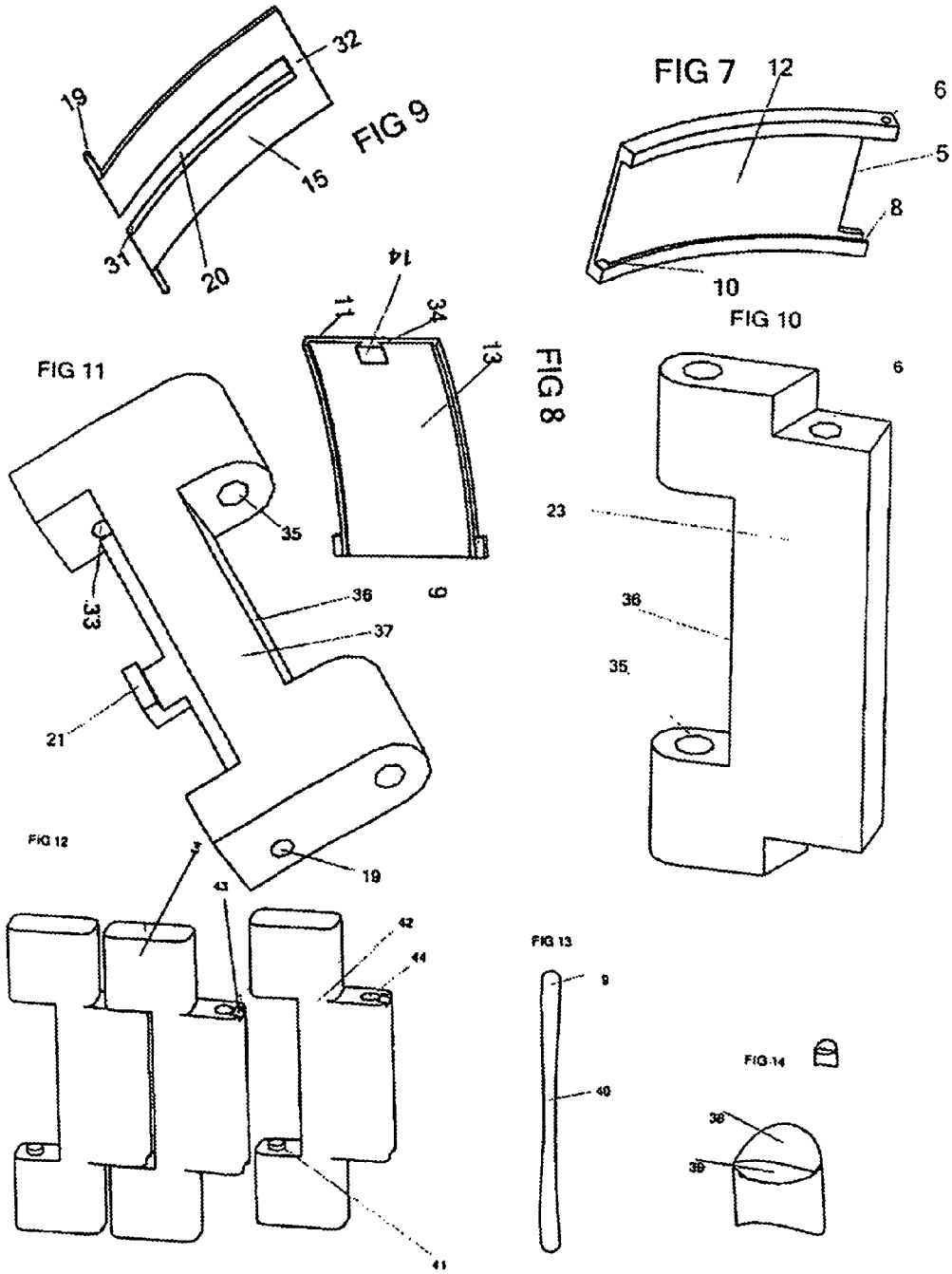

FIG. 7 represents a drawer.

FIG. 8 represents a second drawer.

FIG. 9 represents the prolongation of the telescoping system and hinging system of the hinged cap.

FIG. 10 represents a connecting element between the drawer and the bracelet.

FIG. 11 represents a connecting element with the prolongation part and the bracelet.

FIG. 12 represents the elements composing the bracelet.

FIG. 13 represents pin with holding curve.

FIG. 14 represents one function for preventing derailing in the lengthening motion of the bracelet.

BEST WAY TO APPLY THE INVENTION

FIG. 1 represents a watch 1, followed by a connecting piece 1, hinged using a pin with a curved section 24.

FIG. 12 represents links 3 with forced methods for coupling due to flexibility 42 and a protrusion 41 and a diagonal groove 43 and an opening 44. The whole mechanism, once assembled, forms a connection between the watch and the telescoping system.

FIG. 3 represents the telescoping system composed of a drawer 12 (FIG. 7), with a method for guiding 5 and 8, followed by a stopping notch at the end of the path 10, all this on both sides of the drawer. The edges of the drawer possess grooves 7 over the entire length put there for coupling with thee cap 25. A second groove 13 (FIG. 8) features two stopping notches 9, at the end, borders 11, a coupling button 14 with a notch 34, which hooks into slot 20. The movements are done in a synchronized manner.

The second drawer FIG. 8 is guided into FIG. 7 (see openings 5 and 8) in order to slide all the way to the constraint of the notches 10 (FIG. 7) and the notches 9 (FIG. 8). A third piece 15 (FIG. 9), a flexible part 32, through the pins 19, opening 20, with diagonal angles on both sides 31, couples with button 14 (FIG. 8). This button has diagonal angles that are matched with the opening 20, at the diagonal angles 31 (FIG. 9) with a back and forth sliding motion, prolonging and shortening, the length of the telescoping systems. Once the setting up of the telescoping system is complete, part 37 (FIG. 11), already fixed to connection 4, possesses a method for receiving part 15 (FIG. 9), through flexibility 32, which become inserted to facilitate the matching of these pins 19 in the holes 33, to fix and hinge the telescopic system (FIG. 3), the cap 25, and the bracelet 4. Part 37 possesses a method represented by a tong 21, which comes to stabilize and prevent part 15 from pushing out and disconnecting the hinge between the telescopic system, the cap and the bracelet when the security system is used by the wearer.

The invention claimed is:

1. A safety device for a bracelet including a system for adjusting the circumferential length of the bracelet, wherein the system comprises:

first and second curvilinear elongated elements, each having a slot and a plurality of notches a clasp comprising a third curvilinear elongated element having a set of grooves, wherein the grooves receive one of the first or second elongated elements for slidably gliding the elements relative to one another, and a fourth curvilinear elongated element a button slidably secured in each slot of said first and second curvilinear elongated elements to slidably secure said first and second curvilinear elongated elements together a set of stop reliefs are provided within said grooves for limiting the sliding motion of the first and second curvilinear elongated elements wherein the third and fourth curvilinear elongated elements are engaged with one another after the safety device is adjusted to a desired position in order to lock the device in that desired position.

* * * * *